United States Patent [19]

Juhuku

[11] Patent Number: 4,829,895

[45] Date of Patent: May 16, 1989

[54] REFUSE COMPACTION UNIT HAVING INTERDIGITATING ROTOR AND STATOR BLADER

[75] Inventor: Hiroki Juhuku, Tokyo, Japan

[73] Assignee: Hakushin Kogyo Co., Ltd., Tokyo, Japan

[21] Appl. No.: 113,330

[22] Filed: Oct. 26, 1987

Related U.S. Application Data

[63] Continuation of Ser. No. 920,160, Oct. 17, 1986, abandoned, which is a continuation of Ser. No. 792,189, Oct. 28, 1985, Pat. No. 4,658,717, which is a continuation of Ser. No. 621,390, Jun. 18, 1984, abandoned.

[30] Foreign Application Priority Data

Jun. 17, 1983 [JP] Japan ..... 58-107795

[51] Int. Cl.[4] ..... B30B 9/02

[52] U.S. Cl. ..... 100/126; 100/37; 100/144; 100/177

[58] Field of Search ..... 100/104, 110, 116, 118, 100/121, 177, 178, 144, 37, 41, 94, 98 R, 97, 126; 141/71

[56] References Cited

U.S. PATENT DOCUMENTS

| | | | |
|---|---|---|---|
| 2,121,932 | 6/1938 | Slocum | 100/177 |
| 3,593,656 | 7/1971 | Churchman | 100/177 |
| 3,888,170 | 6/1975 | Doering | 100/177 |
| 4,046,068 | 9/1977 | Eggenmuller | 100/177 X |
| 4,621,666 | 11/1986 | Ryan | 100/177 X |

FOREIGN PATENT DOCUMENTS

| | | | |
|---|---|---|---|
| 223601 | 8/1892 | France | 100/144 |

*Primary Examiner*—Andrew M. Falik

*Attorney, Agent, or Firm*—Wegner & Bretschneider

[57] ABSTRACT

A refuse compaction unit comprises a refuse inlet, a compactor located below the refuse inlet and communicating therewith and an outlet communicating with the compactor on the opposite side thereof from the refuse inlet, the compactor being constituted of at least one comb-like rotor consited of a plurality of outwardly projecting blades and at least one comb-like stator acting as a partition between the refuse inlet and refuse outlet and having a plurality of teeth with which the blades of the comb-like rotor interdigitate.

6 Claims, 1 Drawing Sheet

REFUSE COMPACTION UNIT HAVING INTERDIGITATING ROTOR AND STATOR BLADER

This application is a continuation of U.S. application Ser. No. 920,160, filed Oct. 17, 1986, now abandoned, which is a continuation of U.S. application Ser. No. 792,189, filed Oct. 28, 1985, now U.S. Pat. No. 4,658,717, issued Apr. 21, 1987, which is a continuation of U.S. application Ser. No. 621,390, filed June 18, 1984, now abandoned.

BACKGROUND OF THE INVENTION

1. Field of the Invention

This invention relates to a refuse compaction unit for reducing the volume of various kinds of waste materials.

2. Description of the Prior Art

In disposing of plastic, paper and other types of containers and the leftover food contained therein, it is the general practice to separate the containers from the contents and throw these into separate trash bins (bags, boxes etc.) either as they are or as somewhat compacted by the application of moderate pressure. This practice is, however, inefficient from the point of the large volume of the refuse discarded into the trash bins etc. Moreover, it has been difficult to realize any substantial degree of volume reduction by only a moderate degree of compaction since the containers in the refuse tend to spring back to their pre-compressed shape. Although it has been known that chopping or shredding of such containers is effective toward removing the air from the containers included in the refuse, the conventional chopping and shredding machines used for this purpose have been designed only to cut up the containers and have not been capable of compacting the refuse. What is more, these conventional machines are noisy and susceptible to clogging when small stones or metal pieces are contained in the refuse.

SUMMARY OF THE INVENTION

In view of the foregoing observations and description, the object of this invention is to provide a refuse compaction unit which facilitates the disposal of refuse by compacting and removing water from the refuse, the unit comprising a refuse inlet, a compactor located below the refuse inlet and communicating therewith and an outlet communicating with the compactor on the opposite side thereof from the refuse inlet, the compactor being constituted of at least one comb-like rotor consisting of a plurality of outwardly projecting blades and at least one comb-like stator acting as a partition between the refuse inlet and refuse outlet and having a plurality of teeth with which the blades of the comb-like rotor interdigitate.

DESCRIPTION OF THE PREFERRED EMBODIMENTS

Figure 1:
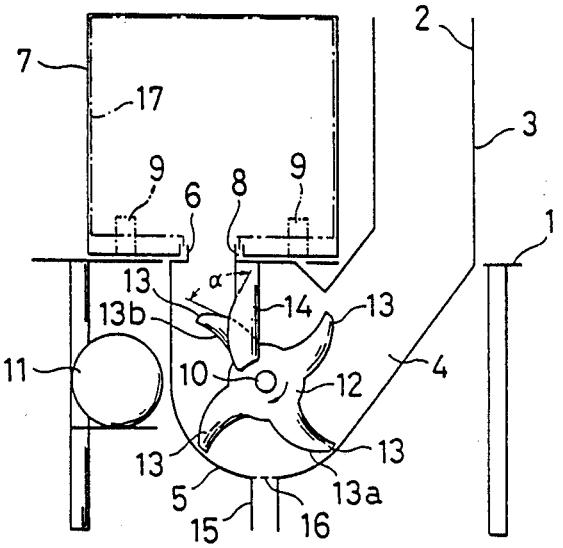
FIG. 1 is a vertical cross-sectional view of one embodiment of the refuse compaction unit according to this invention.

Referring to the first embodiment of the invention shown in FIG. 1, a hopper 3 having a refuse inlet 2 at the upper end thereof is provided on a base 1. Connected with the lower end of the hopper 3 is a compactor 4 housed within a casing 5 having an arcuate lower wall. Directly above the compactor 4 is an outlet 6 which communicates with a sealed storage compartment 7 via an opening 8 therein.

The storage compartment 7 is swingably supported on the base 1 by hinges 9, 9 so that when necessary it can be turned upside down to position the opening 8 at the top.

Figure 2:
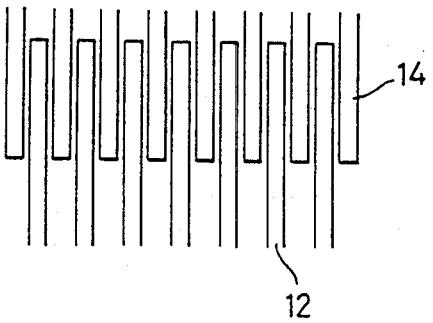
FIG. 2 is an enlarged view showing the interdigitated state of the rotor and stator shown in FIG. 1.

Within the compactor 4 is provided a shaft 10 positioned at the center of curvature of the arcuate wall of the casing 5. The shaft 10 is driven in the direction indicated by the arrow in the figure by a motor 11 mounted on the base 1. The motor 11 and the shaft 10 are linked by a chain (not shown). The shaft 10 has fitted thereon a comb-like rotor 12 having a plurality of outwardly projecting planar blades 13. The rotor 12 rotates together with the shaft 10 in the direction of the arrow. The blades 13 extend to have their tips come just short of the arcuate wall of the casing 5 and the leading edge 13*a* of each blade 13 is formed as a convex arc while the trailing edge thereof is formed as a concave arc. A comb-like stator 14 extends downward from the upper wall of the casing 5 in the form of a partition between the hopper 3 and the outlet 6. The teeth of the comb-like rotor interdigitate with the teeth of the comb-like stator as shown in FIG. 2. The angle $\alpha$ formed between the leading edges of the blades 13 of the rotor 12 and the stator 14 (see FIG. 1) is, generally speaking, preferably 90°, but in cases where the refuse being compacted is particularly slippery, better results may be obtained with an angle of less than 90°.

At the lowermost portion of the casing 5 of the compactor 4 is provided a drain pipe 15 covered at the top end with a filter 16. If desired, this drain pipe 15 can be replaced by a tank.

The operation of this embodiment will now be explained.

First a refuse bag 17 is inserted into the storage compartment 7 and the storage compartment 7 is then positioned over the outlet 6 so that the refuse bag 17 will communicate therewith. Next the motor 11 is started to cause the rotor 12 to rotate in the direction of the arrow. When refuse is then dropped into the hopper 3 through the inlet 2, it falls as far as the compactor 4 where it is caught by the blades 13 and carried upward while being compacted and, to some degree, deprived of water. Then when the blades pass through the stator 14, it is further deprived of water and compacted to an even higher degree. Thus, as more and more refuse is dropped into the hopper 3, the refuse in the compactor 4 which has been deprived of water progressively stacks up in the direction of the outlet 6 and is pushed upward into the storage compartment 7, where it is stored. The action of pushing the refuse into the storage compartment 7, remembering that the storage compartment is sealed and of fixed capacity, causes further compaction further decreasing the volume of the compacted refuse material.

When the storage compartment 7 has become filled with compacted refuse, it is only necessary to swing the storage compartment upside down and remove the refuse-filled bag 17 from the opening 8. The volume of the refuse in the bag 17 will be approximately 1/5 that of the refuse prior to compacting and water removal.

The water extracted from the refuse is discharged via the drain pipe 15.

As is clear from the foregoing, this embodiment of the invention makes it possible to dispose of refuse very efficiently since it enables the user to continuously compact the refuse to about 1/5 its initial volume.

Here it should be noted that the outlet 6 need not necessarily be provided above the compactor 4 as described above but may instead be positioned at the side thereof.

Figure 3:
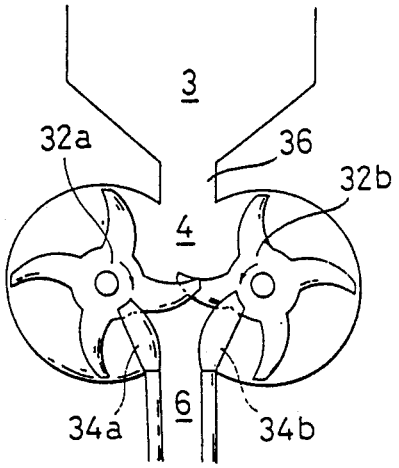
FIG. 3 is a vertical cross-sectional view of another embodiment of the refuse compaction unit according to the invention.

Another embodiment of the refuse compaction unit according to this invention is shown in FIG. 3. This embodiment has a pair of comb-like rotors 32*a*, 32*b* each comprising a plurality of blades and a pair of comb-like stators 34*a*, 34*b*, the teeth of the blades of the rotors 32*a*, 32*b* being arranged to interdigitate with the teeth of the respective stators 34*a*, 34*b*. The hopper 3 in this embodiment is located so that a feed passage 36 thereof opens into the compactor 4 midway between the two rotors 32*a* and 32*b*. As shown by the arrows, the rotors 32*a*, 32*b* rotate in opposite directions so as to carry refuse entering from the feed passage 36 downward toward the outlet 6 which, in this embodiment, is situated below the compactor 4. As in the embodiment described above, the leading edge of each rotor blade is formed as a convex arc while the trailing edge is formed as a concave arc. The two rotors 3 may be arranged so that their blades will pass through each other as shown in the figure, so that a small space will remain therebetween, or so that the blades rotate out of phase and do not pass through each other the exact arrangement to be used being determined on the basis of the type of refuse to be compacted.

In operation, a refuse box (not shown) is inserted into the storage compartment (not shown) and the storage compartment is fixed over the outlet 6 so that compacted refuse from the outlet will pass into the refuse box. Then, after starting a motor (not shown) to set the rotors 32*a*, 32*b* into rotation in the direction of the arrows, refuse in thrown into the hopper 3 from the inlet at the top. This refuse falls downward through the feed passage 36 to be caught between the comb-like blades of the oppositely rotating rotors 32*a*, 32*b*. The refuse entering from the hopper is thus forced in the direction of the outlet 6 while at the same time being compacted and deprived of water. The compacted refuse of considerably reduced volume is fed into the refuse box. As more and more refuse is thrown into the hopper, it is continuously subjected to this compaction process and fed into the refuse box.

Thanks to the provision of two rotors in this embodiment, the rate at which refuse can be compacted is speeded up and the amount of compacting pressure brought to bear on the refuse is increased to substantially upgrade the efficiency of the compacting operation. Moreover, the increased compacting force achieved by the use of two rotors makes it possible to use the unit not only for relatively easily compressible kitchen refuse but also for general industrial refuse containing pieces of glass and metal.

It should be noted that the positions of the rotors and stators are not limited to those shown in the drawings and that the location of the refuse storage compartment is not limited to that shown in FIG. 1.

Thus, as described above, the refuse compaction unit according to this invention comprises a refuse inlet, a compactor located below the refuse inlet and communicating therewith and an outlet communicating with the compactor on the opposite side thereof from the refuse inlet, the compactor being constituted of at least one comb-like rotor consisting of a plurality of outwardly projecting blades and at least one comb-like stator acting as a partition between the refuse inlet and refuse outlet and having a plurality of teeth with which the blades of the comb-like rotor interdigitate. As a consequence, although compactly constructed, the refuse compaction unit can nevertheless continuously compact refuse in a highly satisfactory manner and provide an improvement in the operation of refuse disposal.

I claim:

1. A refuse compaction unit comprising a refuse inlet, a compactor located below the refuse inlet and communicating therewith, an outlet communicating with the compactor on the opposite side thereof from the refuse inlet, and a sealed storage compartment in communication with said outlet at the end thereof opposite said compactor, the compactor comprising at least one comb-like rotor comprising a plurality of sets of outwardly projecting planar blades arranged in rows parallel to the axis of the shaft, and at least one comb-like stator acting as a partition between the refuse inlet and refuse outlet and having a plurality of planar blades arranged in a row, said rotor being rotatable so as to cause all of the plurality of planar blades in a given row, of the rotor to interdigitate with all the blades of the stator while allowing little refuse to pass through the stator.

2. A refuse compaction unit according to claim 1 wherein a leading edge of the blades of the rotor are formed as a convex arc and the trailing edge thereof is formed as a concave arc.

3. A refuse compaction unit according to claim 2, further comprising a drain pipe at a bottom of the compactor.

4. A refuse compaction unit according to claim 2, wherein the exposed face of the stator blades are curved such that when the rotor blades pass through the stator blades a constant angle between the leading edge of the rotor blade and the curved edge of the stator blade is maintained.

5. A refuse compaction unit according to claim 1 further comprising a drain pipe at a bottom of the compactor.

6. A refuse compaction unit according to claim 1 wherein the compactor being constituted of a plurality of comb-like rotors consisting of a plurality of outwardly projecting blades and a plurality of comb-like stators acting as a partition between the refuse inlet and refuse outlet and having a plurality of blades with which the blades of the comb-like rotor interdigitate.

* * * * *

UNITED STATES PATENT AND TRADEMARK OFFICE

CERTIFICATE OF CORRECTION

PATENT NO. : 4,829,895

DATED : May 16, 1989

INVENTOR(S) : Hiroki JUHUKU

It is certified that error appears in the above-identified patent and that said Letters Patent is hereby corrected as shown below:

In the title, change "BLADER" to --BLADES--.

Column 1, line 3, change "BLADER" to --BLADES--.

Signed and Sealed this

Twenty-ninth Day of May, 1990

*Attest:*

HARRY F. MANBECK, JR.

*Attesting Officer*

*Commissioner of Patents and Trademarks*